US011233309B2

(12) United States Patent
Moheb et al.

(10) Patent No.: US 11,233,309 B2
(45) Date of Patent: Jan. 25, 2022

(54) ANTENNA ASSEMBLY, AND THE INSTALLATION AND LOCATION OF AN ANTENNA ASSEMBLY

(71) Applicant: Global Invacom Ltd, Stevenage (GB)

(72) Inventors: Hamid Moheb, Smithfield, NC (US); Kyle Williamson, Smithfield, NC (US); John Baier, Smithfield, NC (US); Jeffrey Werth, Campbellsport, WI (US)

(73) Assignee: Global Invacom Ltd., Stevenage (GB)

( * ) Notice: Subject to any disclaimer, the term of this patent is extended or adjusted under 35 U.S.C. 154(b) by 0 days.

(21) Appl. No.: 16/489,220

(22) PCT Filed: Mar. 5, 2018

(86) PCT No.: PCT/GB2018/050552
§ 371 (c)(1),
(2) Date: Aug. 27, 2019

(87) PCT Pub. No.: WO2018/158594
PCT Pub. Date: Sep. 7, 2018

(65) Prior Publication Data

US 2020/0006839 A1 Jan. 2, 2020

(30) Foreign Application Priority Data

Mar. 3, 2017 (GB) ..... 1703442

(51) Int. Cl.
*H01Q 1/12* (2006.01)
*H01Q 3/08* (2006.01)

(52) U.S. Cl.
CPC ..... *H01Q 1/1235* (2013.01); *H01Q 1/125* (2013.01); *H01Q 3/08* (2013.01)

(58) Field of Classification Search
CPC .. H01Q 1/12; H01Q 1/18; H01Q 1/34; H01Q 1/125; H01Q 1/1207; H01Q 1/1235; H01Q 1/3275
See application file for complete search history.

(56) References Cited

U.S. PATENT DOCUMENTS 4,994,816 A 2/1991 Kondo
5,337,062 A * 8/1994 Sherwood ..... H01Q 1/3275 343/711
5,646,638 A * 7/1997 Winegard ..... H01Q 1/08 343/840
7,142,168 B1 11/2006 Sinclair
(Continued)

FOREIGN PATENT DOCUMENTS

EP 1798810 A2 6/2007
WO 2009088111 A1 7/2009

*Primary Examiner* — Tung X Le
(74) *Attorney, Agent, or Firm* — Gable Gotwals

(57) ABSTRACT

An antenna assembly for use particularly where relatively rapid deployment and/or disassembly of the same is required thereby making the same available to be used at a location quickly. The assembly includes a hub to which are movably mounted a bracket for attachment of an antenna, which may comprise a plurality of parts, and support legs which are movable between in use and storage positions. First and second adjustments for the azimuth and elevation of the antenna are provided for use when the antenna, bracket and support legs are in the in-use position.

18 Claims, 10 Drawing Sheets

(56) References Cited

U.S. PATENT DOCUMENTS

| | | | | |
|---|---|---|---|---|
| 9,577,313 | B2 * | 2/2017 | Nielsen | H01Q 3/08 |
| 2010/0259462 | A1 * | 10/2010 | Yeh | H01Q 3/02 343/882 |
| 2011/0095956 | A1 * | 4/2011 | Conrad | H01Q 19/12 343/840 |
| 2012/0068899 | A1 | 3/2012 | Ayotte et al. | |
| 2015/0349417 | A1 * | 12/2015 | Richards | H01Q 1/1264 342/352 |

* cited by examiner

ANTENNA ASSEMBLY, AND THE INSTALLATION AND LOCATION OF AN ANTENNA ASSEMBLY

CROSS-REFERENCE TO RELATED APPLICATIONS

This United States application is the National Phase of PCT Application No. PCT/GB2018/050552 filed 5 Mar. 2018, which claims priority to British Patent Application No. 1703442.2 filed 3 Mar. 2017, each of which is incorporated herein by reference.

The invention to which this application relates is a mounting system for use particularly, although not necessarily exclusively, in the mounting of an antenna assembly on a support surface, in one embodiment in the form of a mounting assembly, such as a tripod, mounted on the ground.

The provision of an antenna assembly to receive broadcast data signals, such as those which are broadcast and transmitted by a satellite transmission system. Typically, at any location where it is desired to receive the satellite transmitted data signals, such as a location where a subscription has been taken out by a person to receive the data signals for a television and/or radio service, or, in other uses, such as military usage, an antenna assembly is required to be mounted on a support and the antenna is required to be directed towards the position which is optimum for the best reception of data signals from one or more satellites. This allows any errors in the reception of the data signals to be minimised, and which errors can cause disruption to the service generated to the end user by processing the data signals downstream of the antenna.

Conventionally, the antenna assembly comprises an antenna that is mounted on a bracket at the rear surface of the antenna which, in turn, is located on a support, and an arm is provided to the front of the antenna on which a receiver or transceiver and/or other data processing means are mounted. The bracket is, in turn, located on a pole or tripod that provides the support for the position of the antenna and maintains that antenna in that position during use.

Conventionally, at least part of the assembly is required to be assembled on site so that, in addition to the mechanical connection of the components, it is also then necessary to adjust the relative positions of the components of the apparatus and particularly the location of the antenna in relation to the bracket and/or support to adjust the same with respect to the satellites from which the data signals are received at the location of use.

In order to ensure that the transmitted data signals are received by the antenna with sufficient accuracy so that any error in the data signals is sufficiently low so as to not disrupt the subsequent processing of the signals, it is important that the antenna assembly is correctly and accurately located at the time of installation. This requirement for accuracy may vary between different types of antenna and/or their uses but is always a requirement. For example, with certain types of antenna, such as a very small aperture terminal (VSAT) antenna, which is typically a two way transmission system and which can be used in transportable, "on-the-move" systems such as military, emergency situations and temporary site requirements and/or mobile maritime communications, there is a need for relatively skilled personnel to be used to install and deploy the apparatus in order for the same to operate satisfactorily. The requirement of skilled personnel to be used, on site, means that the cost of installation of the apparatus is relatively high. However, until now, the cost has been deemed to be unavoidable, due to the requirement for the skilled deployment and setting of the apparatus in order for the same to operate effectively.

An aim of the present invention is therefore to allow the antenna apparatus to be provided to be used at a location in a manner which can be installed and deployed by personnel who need not have the same level of skill as is conventionally required and, as a result, thereby reduce the cost of installation whilst, at the same time, ensuring that the accuracy of installation of the assembly is maintained. A further aim is to allow the apparatus, if required, to be installed and disassembled relatively rapidly so as to suit particular usage requirements, such as military usage requirements.

In a first aspect of the invention, there is provided an antenna assembly, said assembly including an antenna mounted on a bracket having a first part for location with the antenna and a second part in location with a hub of a support which includes a plurality of legs and adjustment means to allow the selective adjustment of the azimuth and/or elevation position of the antenna with respect to the support wherein the bracket is selectively movable between storage and in-use conditions with respect to said hub via an axis of a pivot connection at, or adjacent to, a first side of the hub.

In one embodiment the support legs are each pivotally connected to the said hub and are pivotally movable about their respective axes between storage and in-use conditions. In one embodiment the connections of the legs to the hub are at an edge of the hub or on the side of the hub opposing the said first side of the hub In one embodiment the said axes about which the support legs are moved are substantially perpendicular to the axis about which the bracket is movable.

In one embodiment locking means are provided so as to retain the bracket and the support legs in respective in-use positions.

In one embodiment the support legs are equally spaced around the hub when in the in use positions and lie substantially adjacent each other when in the storage position. In one embodiment the bracket lies substantially in line with the support legs when in the storage position but spaced therefrom on the opposing side of the hub.

In one embodiment the bracket allows the connection and location therewith of a multi part antenna. In one embodiment the antenna is separably formed of first and second parts joined together along an interface which passes substantially along a diameter of the antenna when formed. Typically, when in a storage condition, the first and second parts overlie each other.

In one embodiment there is provided a boom arm which is selectively attachable to the hub and, when in an operational position, the free end of the same extends to the front of the reflecting surface of the antenna and includes data signal receiving and/or transmitting means mounted thereon.

In one embodiment include a first adjustment actuating means and a second adjustment actuating means which differs to the first adjustment actuation means.

In one embodiment, at least one of the adjustment actuation means, preferably the second adjustment actuation means, are automatically operable and preferably, after the use of the first adjustment actuation means have been operated.

In one embodiment, the first adjustment actuation means allows the relatively coarse adjustment of the position of the antenna with respect to azimuth and/or elevation and the second adjustment actuation means allows the relatively fine adjustment of the said azimuth and/or elevation positions.

In one embodiment, the second adjustment actuation means utilises an automatic directing system which allows software provided in a control means connected to the antenna assembly to determine the extent of adjustment required using the second adjustment actuation means.

In one embodiment the control means include a modem which detects the strength of the received data signal, as adjustment of the position of the antenna is performed and, when the received data signal is detected as being of a predetermined condition, the adjustment is stopped and the antenna position is set. In one embodiment the predetermined condition is the detection of the data signal with a Bit Error Rate which is deemed to be at, or better than, a predetermined value for acceptable further processing to allow the required service to be generated from the received data signals.

In one embodiment, the first adjustment means includes manually operable adjustment actuators and the second adjustment means includes powered actuators which in one embodiment are servo motors.

In a further aspect of the invention, there is provided A method for moving an antenna to an in-use position from a storage position, the said method including the steps of moving support legs pivotally with respect to respective pivot connections on a second side or edge of a support hub to a spaced, in-use, position, moving a bracket pivotally with respect to a pivot connection on a first side of the hub to an in-use position, locating first and second parts of an antenna joined along an interface to the mounting bracket, mounting a boom arm in position on the said hub with a free end with data processing means positioned in front of the reflecting surface of the antenna and wherein first and second adjustment means to provide coarse and fine tuning respectively of azimuth and elevation positions of the antenna are selectively operated to allow adjustment of the position of the antenna by selectively operating, for each of elevation and azimuth, the first adjustment means, locking the same and then selectively operating the second adjustment means which differ to the first adjustment means in order to provide the antenna at the desired position for receipt of the data signals of a predetermined condition.

In one embodiment control means are provided which include a modem which detects the strength of the received data signal as adjustment of the position of the antenna is performed and, when the received data signals are detected as being in the predetermined condition, adjustment is stopped and the antenna position is locked with respect to the support hub and support legs.

In one embodiment the predetermined condition is met when the received data signal has a bit error rate which is at, or better than, a predetermined value.

Specific embodiments of the invention are now described with reference to the accompanying drawings; wherein FIGS. 1*a*, 1*b* and 1*c* illustrate a first embodiment of an antenna assembly in accordance with the invention.

FIGS. 2*a* and 2*b* illustrate features in accordance with an embodiment of the invention.

FIGS. 3*a*, 3*b* and 3*c* illustrate features in accordance with an embodiment of the invention.

FIGS. 4*a* and *b* illustrate a second embodiment of an antenna assembly in accordance with the invention.

Figure 1A:
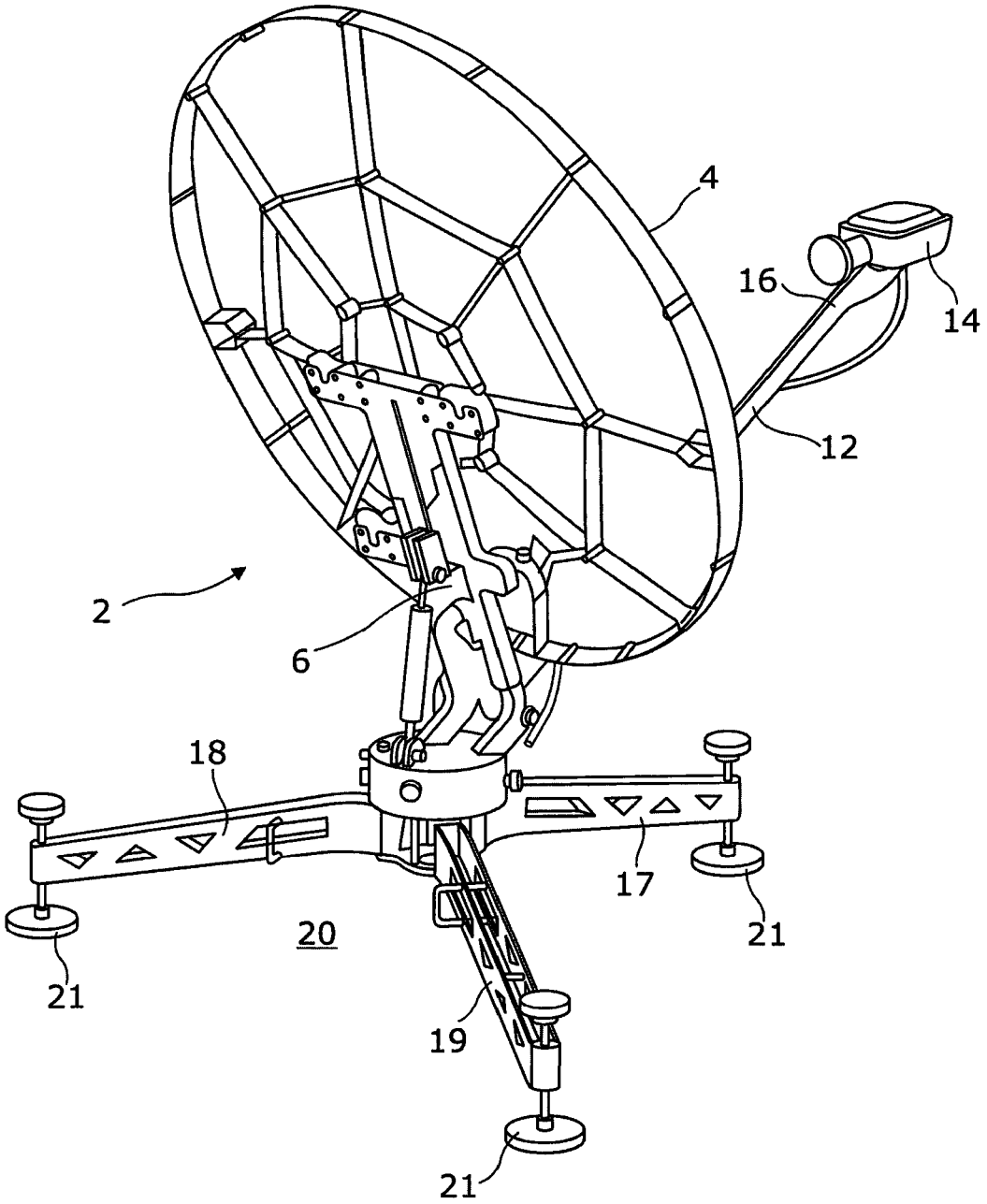

In FIGS. 1-3*c* there is illustrated a first embodiment of the invention. There is provided an antenna assembly 2 which is shown in an in-use position in FIGS. 1*a*-*c*. The assembly includes an antenna or reflector 4 which is mounted via a support bracket 6 located at and in engagement with the rear of the antenna 4 and a support hub 10. Also provided is a boom arm 12 located on the support hub 10 at one end 11 and which typically is provided to receive a transceiver and/or other data signal processing apparatus 14 at the free end 16 thereof. The support hub 10 is also located with support legs 17,18,19 which, in this embodiment form a tripod. Each of the support legs are provided with adjustable height feet 21 to allow the same to be positioned on a support surface, such as the ground 20, and therefore the apparatus can be deployed and supported remotely from any structure, such as may be required for use in temporary locations, for example, in outside broadcast and/or military requirements.

Figure 1C:
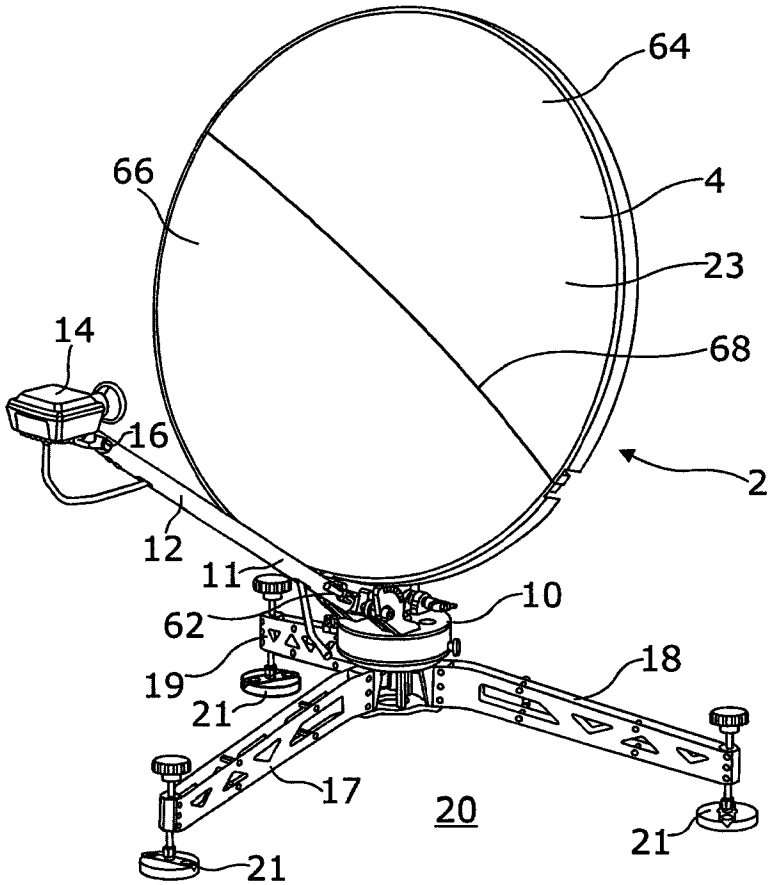
Figure 1B:
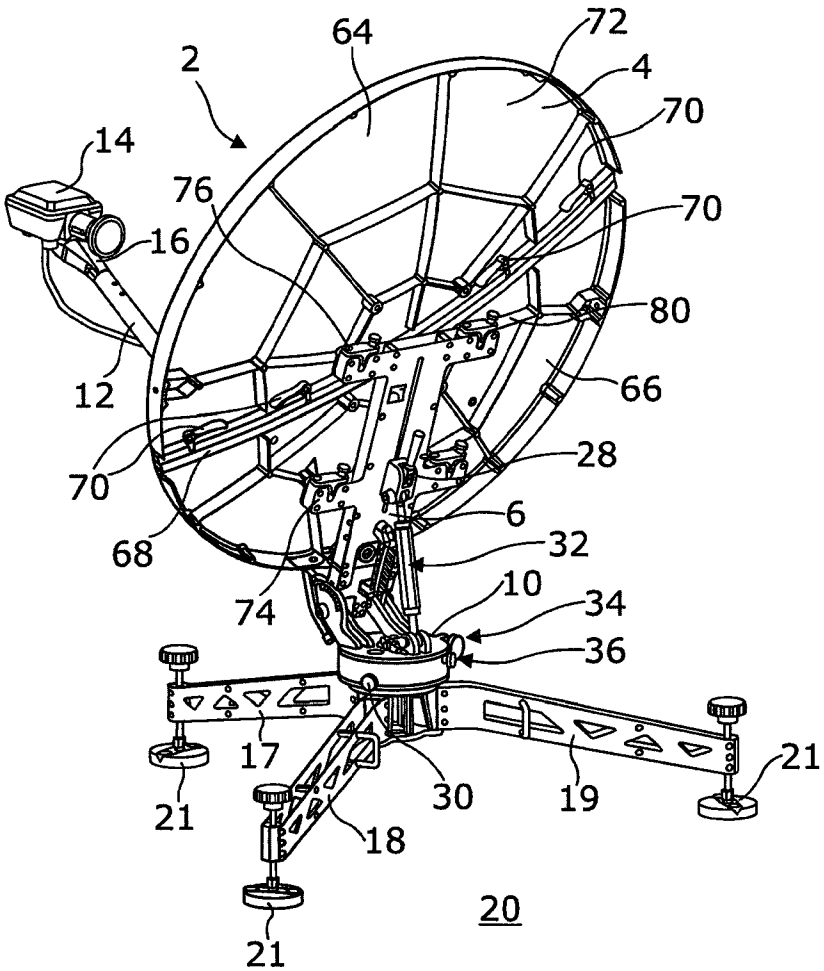

When the antenna assembly is in the in-use position as shown in FIGS. 1*a*-*c* there is a need to be able to adjust and set the position of the antenna 4 so that the same is provided in the optimum position, both with respect to elevation and azimuth orientations, to receive data signals which are transmitted from one or more satellites and thereby allow the data signals which are received on the front surface 23 of the antenna 4 and reflected to the data processing means 14, to be received with a minimum of error. It is known that if the quality of the received data signals is poor due to the incorrect orientation of the antenna 4 and that as a result the data signals include a bit error rate above a certain level, then the quality of the received data signals will be such that the same cannot be accurately processed, in which case the desired service cannot be satisfactorily provided to the user of the antenna assembly.

In accordance with the invention the adjustment is made using two forms of adjustment actuation means for each of the azimuth and elevation positions.

The first adjustment means, as illustrated in FIGS. 1*a*-*c* to FIG. 3*c*, allow relatively coarse adjustment of the position of the antenna and this is provided via a manually rotatable handle and pivot shaft 28 on the bracket 6 for elevation adjustment and a manually rotatable knob with a threaded shaft 30 mounted on the support hub 10 for azimuth adjustment. In use the installer will adjust the position of the handle 28 and knob 30 respectively until, typically, a visual indicator indicates that the required position orientation of the antenna is at a desired location and therefore the antenna is now at or close to the desired position with regard to the geographical location of the assembly at that time and the one or more satellites from and/or to which the data signals are required to pass. At this point the coarse adjustment means 28, 30 can be locked in that position.

Second adjustment means are also provided for each of the elevation and azimuth positions and these are provided in the form of a rotatable sleeve on a threaded shaft 32 to allow the fine elevation adjustment and a knob with a threaded shaft 34 to allow fine azimuth adjustment.

Once the fine adjustment has been performed to more accurately select the orientation of the antenna with respect to azimuth and elevation, then the position is locked in position for optimum use at that location. In this embodiment the locking means are provided integrally with the fine elevation adjustment assembly 32 and a separate locking means 36 is provided on the support hub 10 to lock the fine azimuth position of the antenna 4.

In order to allow the antenna assembly to be deployable and disassembled relatively quickly the antenna or reflector 4, bracket 6, support hub 10, boom arm 12 and support legs can all be manufactured from relatively light weight composite, anodised metal materials. Furthermore as will now be described, the relative positions of the same parts can be changed between storage and in-use positions so, when in the storage position a significantly smaller, and hence more portable assembly can be achieved. In one embodiment the assembly can be formed as three parts when in the storage position comprising, the antenna 4, support hub, bracket and support legs, and the boom arm. In this storage position the assembly may be transportable in two carrying holdalls. Optionally the assembly may include one or more solar panels, charger controller inverter and rechargeable battery in order to allow the operation of the assembly data processing means and other optional powered components remotely from mains or other power sources.

Figure 2B:
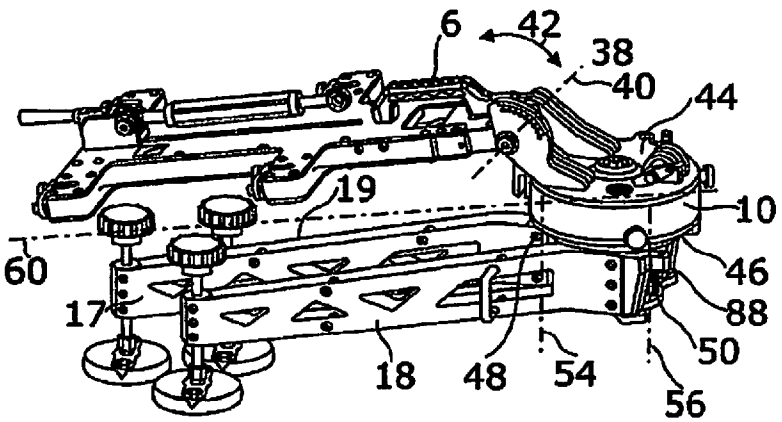
Figure 2A:
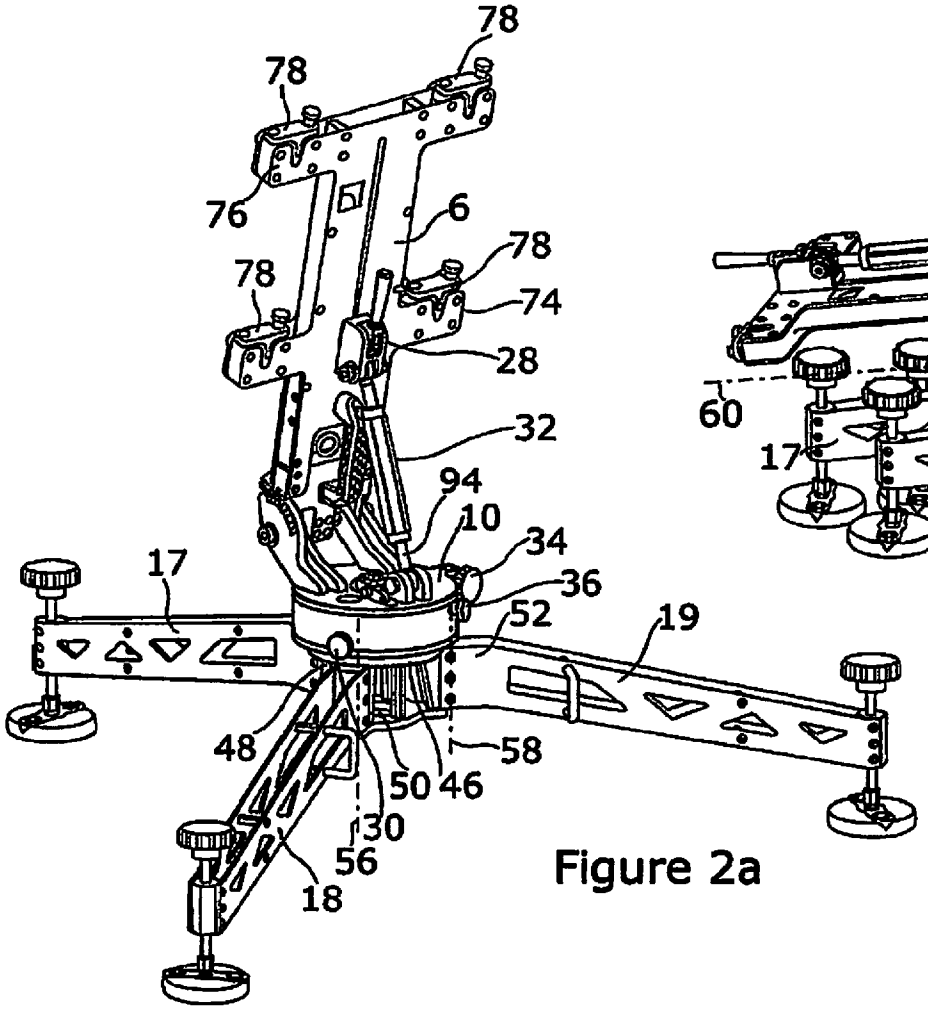

In one embodiment the antenna assembly is provided to operate in the Ka band of data signals and In order to allow the assembly 2 to be movable from the in-use position shown in FIGS. 1*a-c* to the storage position, the assembly components are required to be selectively movable. FIG. 2*b* illustrates the bracket 6, support hub and support legs 17,18,19 of the assembly in a storage position. The bracket 6 is pivotally connected to the support hub 10 via a pivot connection 38 located on a first side 44 of the support hub 10, which allows pivotal movement of the bracket 6 as indicated by arrow 42 about the axis 40 so as to allow the bracket 6 to be selectively moved between the storage position shown in FIG. 2*b* to the in-use position shown in FIG. 2*a*. Each of the support legs 17,18,19 are connected to the edge or, as shown in this embodiment, the second opposing side 46 of the support hub 10 via respective pivot connections 48, 50, 52 which allow pivotal movement of the support legs about respective axes 54, 56, 58 so as to move the support legs from the storage position shown in FIG. 2*b* and the spaced apart in-use position shown in FIG. 2*a*. Typically the axes 54,56,58 are perpendicular to the axis 40.

When in the storage position the support legs 17,18,19 are spaced apart from the bracket 6 by the thickness of the support hub 10 but lie along substantially the same axis 60 to thereby minimise the volume of the same for storage purposes.

The boom arm 12 end 11 can be selectively engaged with the support hub 10 via mechanical connection means 62.

The antenna 4, in this embodiment is formed of first and second segments 64, 66 which, when in the storage position can overlie each other and when in the in-use position are joined together along interface 68 and are held together by "quick release" locking levers 70, spaced long the interface at the rear face 72 on the antenna so as to ensure a smooth front face 23 is formed as shown in FIG. 1*c*. The bracket arms 74, 76 are provided with "quick release" locking levers 78, which are pivotally movable towards the rear surface 72 of the antenna 4 when in position so as to engage with ribs 80 on the rear face and thereby retain the antenna 4 in the in-use position and allow the adjustment of the azimuth and elevation of the same with respect to the support hub 10.

Figure 3B:
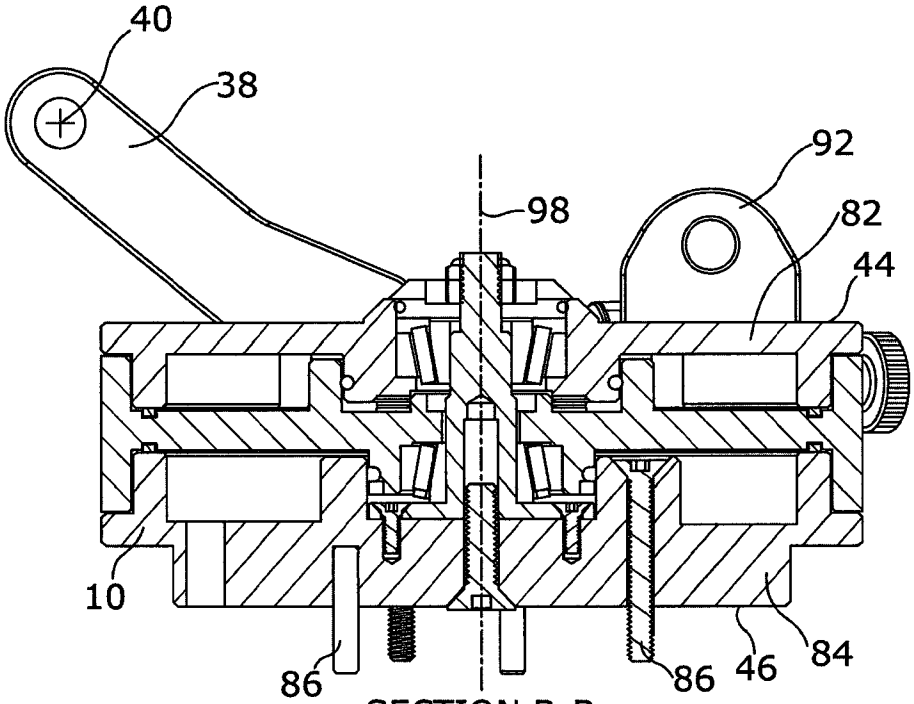
Figure 3A:
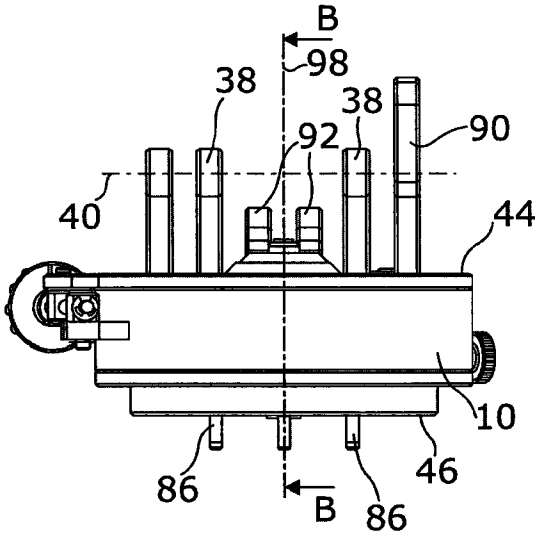
Figure 3C:
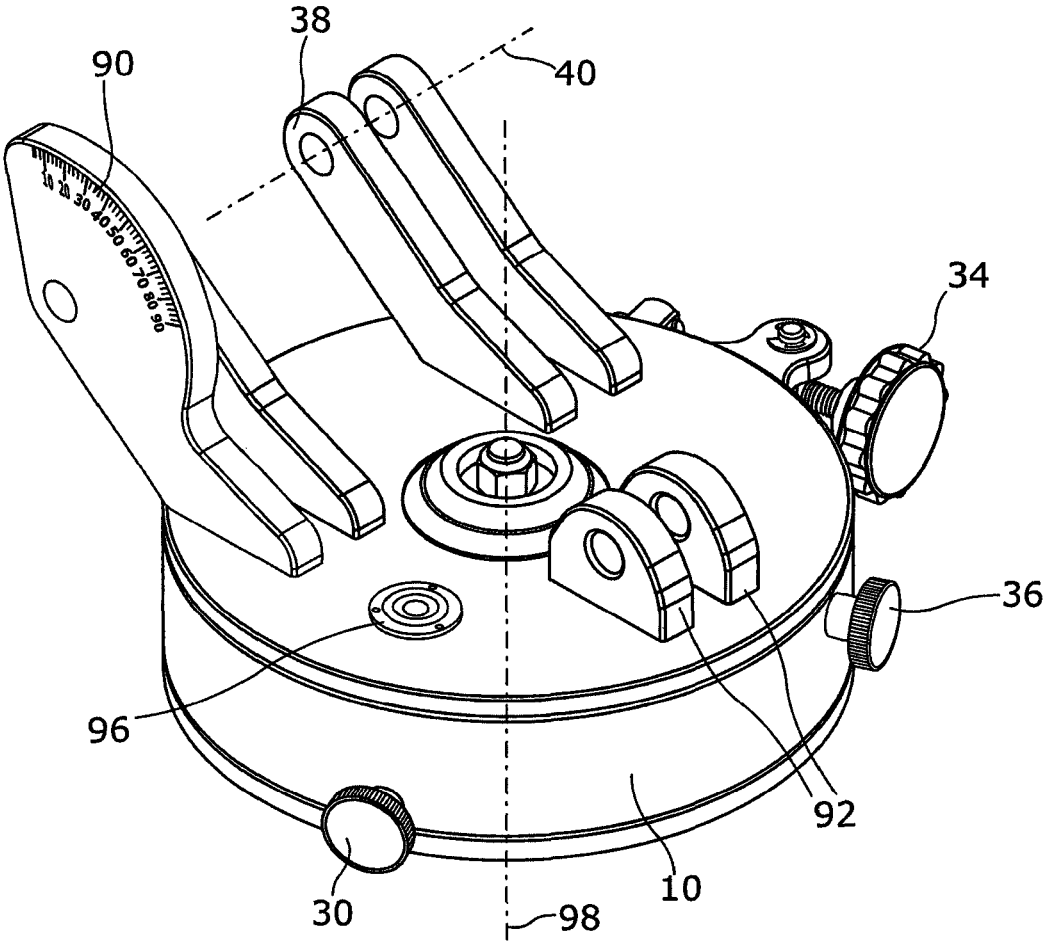

The support hub 10 is shown in more detail in FIGS. 3*a-c* and it will be seen that it comprises an upper part 82 with the first side 44 and a lower part 84 with the second side 46.

The upper part has the pivot connection 38 with which the bracket 6 engages top move about axis 40 and the lower part 84 has engagement means 86 to which the support legs 17,18,19 mounting 88 is engaged.

Also provided on the upper part 82 is the elevation scale 90 to which the user can refer when adjusting the elevation orientation of the antenna 4 and location means 92 for one end of the threaded shaft 94 via which the elevation adjustment can be performed with the coarse adjustment handle 28 at the opposing end of the threaded shaft 94 and the fine adjustment sleeve 32 mounted on the threaded shaft 94. A spirit level indicator 96 is also provided to assist in the positioning and adjustment of the support legs and hence support hub 10. The upper part 82 is rotatably adjustable with respect to the lower part 84 about the axis 98 using bearing assembly 100 in order to allow the adjustment of the azimuth orientation of the antenna 4, bracket 6 and upper part 82 with respect to the remainder of the support hub and support legs the amount of azimuth adjustment is selected by operation of the coarse and fine adjustment knobs 30, 34 and when the desired azimuth adjustment is achieved the relative movement of the upper part 82 with respect to the lower part 84 is locked by the tightening of the locking knob 36.

Figure 4B:
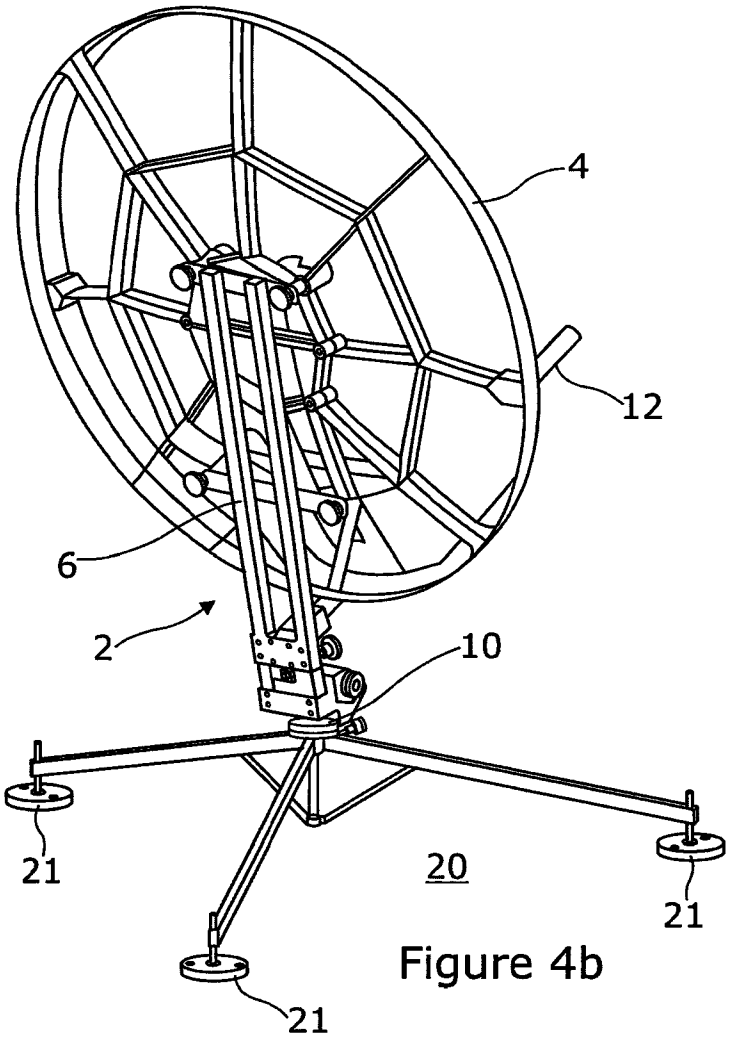
Figure 4A:
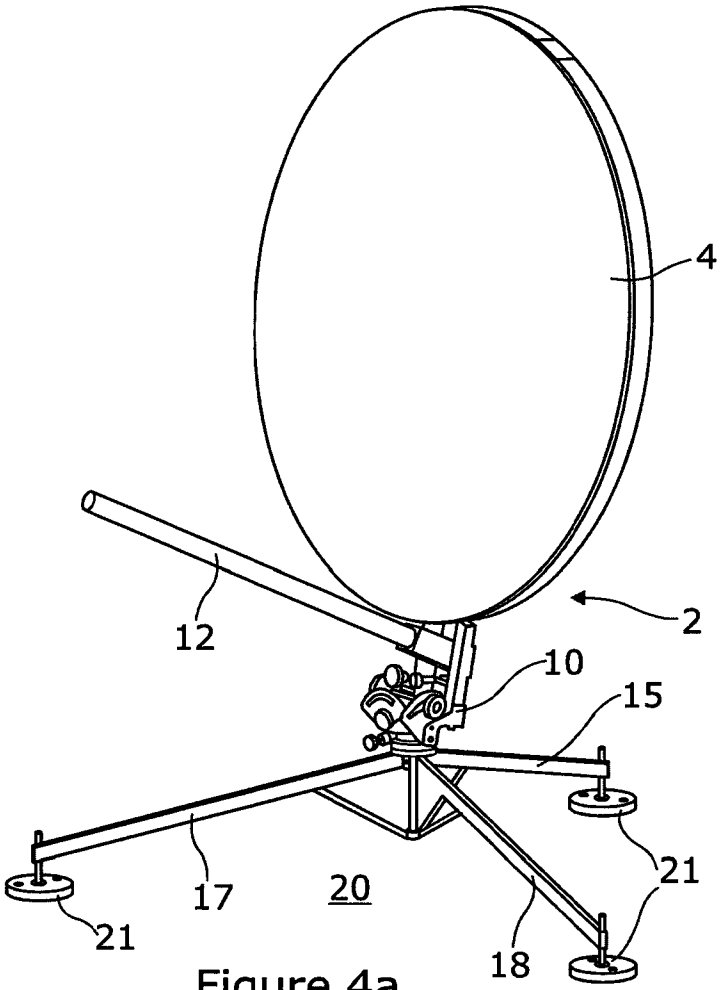
Figure 5:
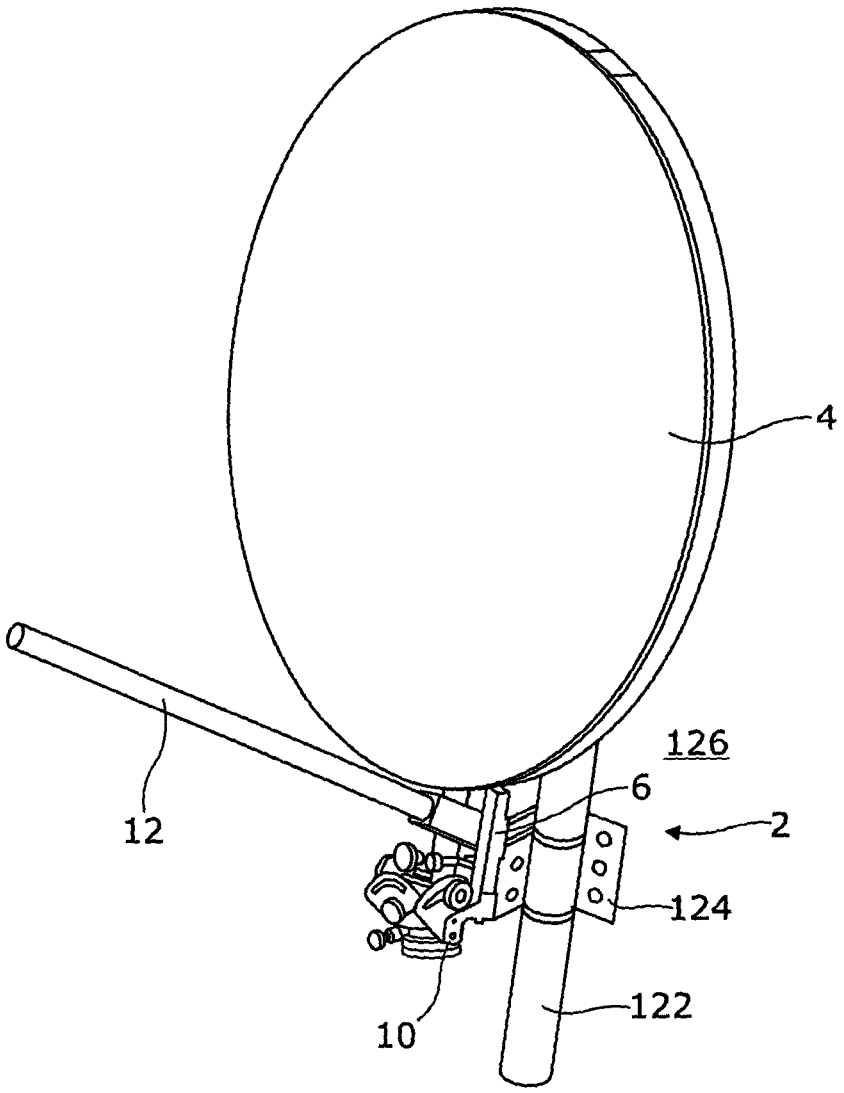
FIG. 5 illustrates a third embodiment of an antenna assembly in accordance with the invention.

In FIGS. 4*a* to 5, there are illustrated second and third embodiments of antenna assemblies. The components of the assembly which are common to the first, second and third embodiments are provided with the same reference numerals. The antenna assembly 2 includes an antenna or reflector 4 which is mounted via a support bracket 6 which has a first part located at the rear of the antenna 4 and a support hub 10. Also provided is a boom arm 12. In FIGS. 4*a* and *b*, the support 10 is shown mounted on a tripod formed by support legs 17,18,19 which is provided with feet 21 to allow the same to be positioned on a support surface such as the ground 20. In FIG. 5, the bracket 6 is located on a pole 122 which, in turn, is provided with a mounting plate 124 which allows the same to be mounted and located on a support surface 126 in the form of, typically, a wall of a building.

In either embodiment, there is a need, once the assembly is provided in a fixed location to be able to adjust and set the position of the antenna 4. In the embodiments shown in FIGS. 1-3*c* and 4*a*-5 the first adjustment actuation means as illustrated in FIGS. 6 and 7 allow relatively coarse adjustment of the position of the antenna and this is provided via manually rotatable knob with a threaded shaft 28 for elevation adjustment and manually rotatable knob with a threaded shaft 30 for azimuth adjustment and the installer will manually rotate the knobs until, typically, a visual indicator on one of the bracket part 8 or hub 10, is visually matched with a predetermined one of a number of graduation markings on the other of the bracket part 8 or hub 10 so that the personnel installing the apparatus can simply adjust using these first adjustment actuation means to bring the antenna to or close to the required position.

Figure 6:
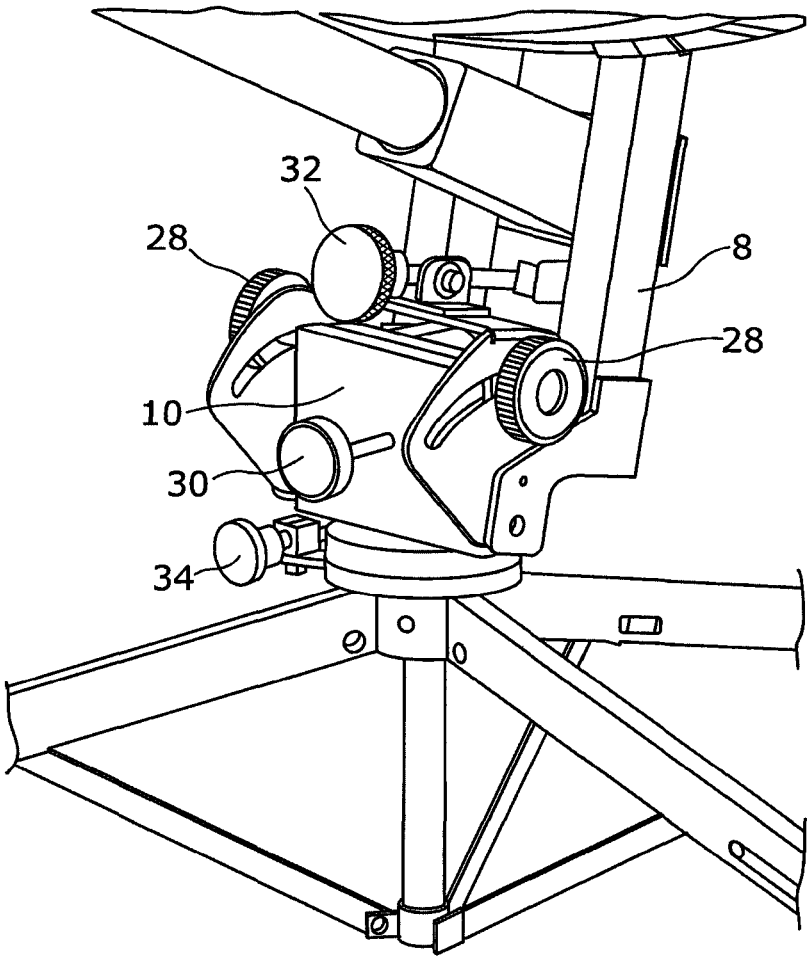
FIG. 6 illustrates adjustment means in accordance with one embodiment of the invention.
Figure 7:
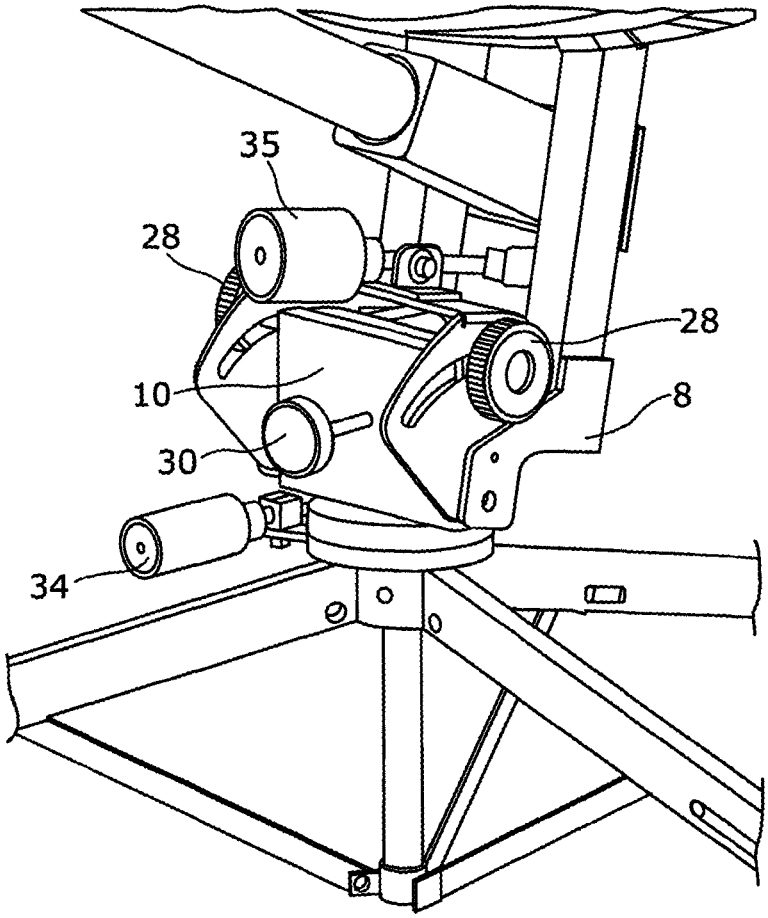
FIG. 7 illustrates adjustment means in accordance with a second embodiment of the invention.

In accordance with FIG. 6 the second adjustment actuation means also includes a manually operable knob with a threaded shaft 32 to allow the fine elevation adjustment and manually operable knob with a threaded shaft 34 to allow fine azimuth adjustment.

However in any of the adjustment arrangement herein described, it is possible for the first, coarse, adjustment means and/or the second, fine, adjustment means to be provided in an automatically operable form. FIG. 7 shows one example and includes the use of a servo motor 35 for the fine elevation adjustment and servo motor 37 for the fine azimuth adjustment. Thus, rather than requiring manual operation or control for the second actuation adjustment, this adjustment is controlled automatically by control means which are connected to the antenna assembly and which monitor the strength and quality of data signals received by the antenna at a particular position as the automatic adjustment of the orientation of the antenna is performed by the control means controlling the operation of the servo motors 36 and 38. When the quality of the received data signals from the antenna is detected as being at or better than a predetermined parameter then the adjustment of the antenna 4 is stopped and the antenna 4 is then set in that position for subsequent use of the assembly.

Figure 8:
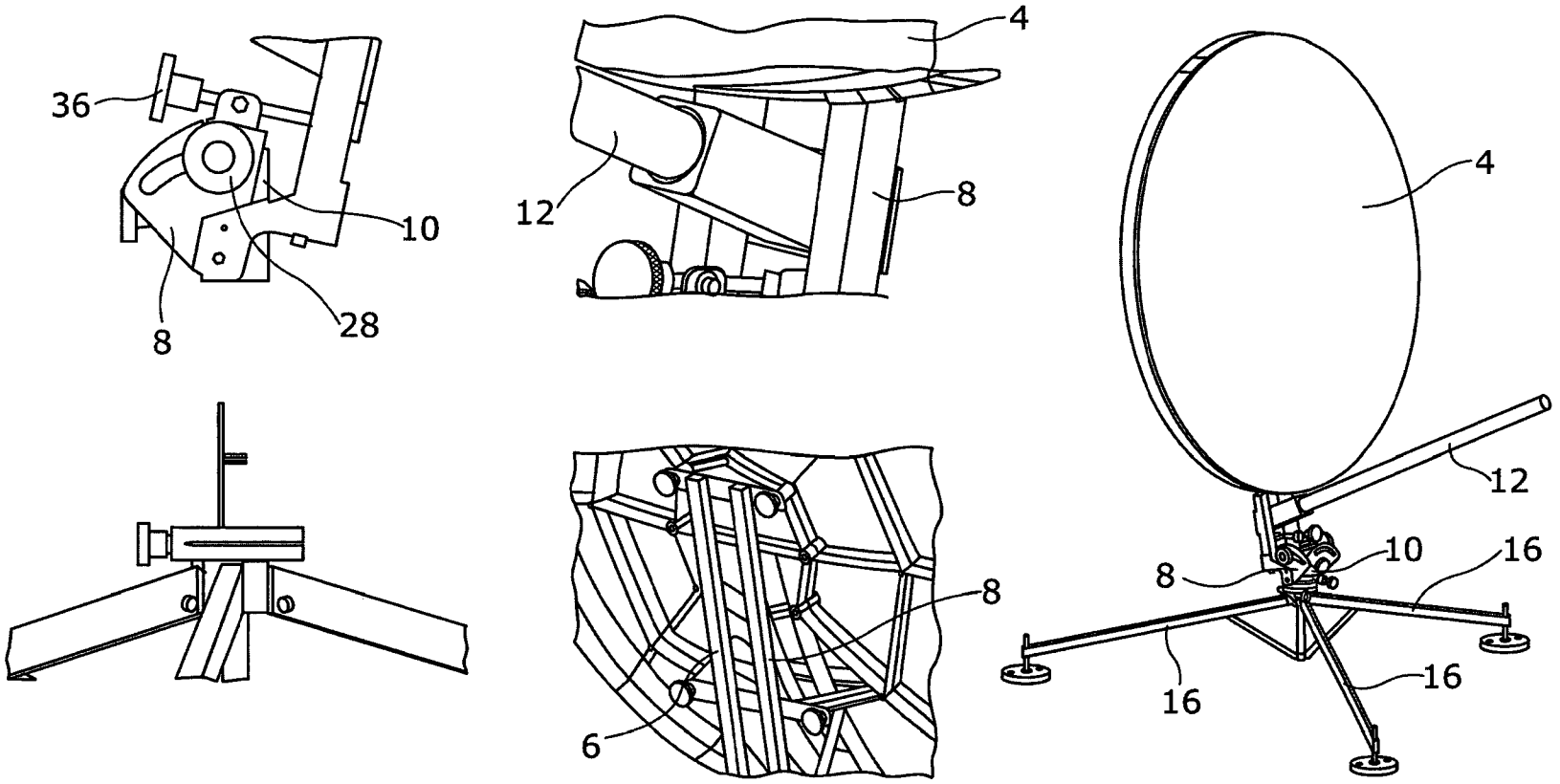
FIG. 8 illustrates the steps which can be performed in the method of assembly of the apparatus in accordance with the invention.

FIG. 8 illustrates the manner in which the antenna assembly 2 of FIGS. 4 and 5 can be assembled in accordance with one embodiment of the invention and subsequent to the installation steps 1 to 4 shown in FIG. 8 the adjustment of the azimuth and elevation orientation of the antenna 4 will be performed.

There is therefore provided in accordance with the invention a relatively rapidly deployable and antenna assembly for use for a variety of possible purposes whilst ensuring that accuracy of receipt and/or transmission of the data signals using the assembly can be achieved at the required geographical location of use. By utilising the two forms of adjustment actuation means then the level of skill required for the installation personnel is reduced and hence the cost of installation is reduced whilst, at the same time, ensuring that the accuracy of installation is maintained and also increasing the speed of installation.

The invention claimed is:

1. An antenna assembly, said assembly comprising:

an antenna mounted on a bracket having a first part for location with the antenna and a second part in location with a hub of a support which includes a plurality of legs and adjustment means to allow selective adjustment of an azimuth and/or elevation position of the antenna with respect to the support, the bracket is selectively movable between storage and in-use conditions with respect to said support hub via an axis of a pivot connection at, or adjacent to, a first side of the hub, first and second adjustment means are provided for elevation and azimuth adjustment of the antenna, and, for each of the elevation and azimuth orientation of the antenna, the first adjustment means to allow coarse adjustment of the position of the antenna with respect to the support hub and the second adjustment means to allow fine adjustment of the position of the antenna with respect to the support hub, wherein actuation of the first and/or second adjustment means for elevation and/or azimuth are actuated by powered drive means, and adjustment of the second adjusting means is controlled by an automatic directing system utilizing a control means connected to the antenna assembly to determine an extent of an adjustment required using the second adjustment actuation means.

2. The antenna assembly according to claim 1, wherein the support legs are each pivotally connected to the hub and are pivotally movable about respective axes between storage and in-use conditions.

3. The antenna assembly according to claim 2, wherein the connections of the plurality of legs to the hub are at an edge of the hub or on a side of the hub opposing the first side of the hub.

4. The antenna assembly according to claim 2, wherein the axes about which the support legs are moved are substantially parallel and said axes are perpendicular to an axis about which the bracket is movable.

5. The antenna assembly according to claim 2, wherein the support legs are substantially equally spaced around the hub when in the in-use position and lie substantially adjacent each other when in the storage position.

6. The antenna assembly according to claim 5, wherein the bracket lies substantially in line with the support legs when in the storage position and spaced therefrom on an opposing side of the hub.

7. The antenna assembly according to claim 1, wherein locking means are provided so as to retain the bracket and the support legs in respective in-use positions.

8. The antenna assembly according to claim 1, wherein the bracket allows the connection and location therewith of the antenna formed of at least first and second segments joined together along an interface.

9. The antenna assembly according to claim 8, wherein the interface passes substantially along a diameter of the antenna when formed and, when in a storage condition, the first and second parts overlie each other.

10. The antenna assembly according to claim 1, wherein there is provided a boom arm which is selectively attachable to the support hub and, when in an operational position, a free end of the boom arm extends to a front of a front reflecting surface of the antenna and includes data signal receiving and/or transmitting means mounted thereon.

11. The antenna assembly according to claim 1, wherein for each of elevation and azimuth orientation of the antenna first adjustment means allow coarse adjustment of a position of the antenna with respect to the support hub and the second adjustment means allows fine adjustment of a position of the antenna with respect to the support hub.

12. The antenna assembly according to claim 11, wherein the assembly includes lock means to allow the coarse adjustment position of the elevation to be locked and retained and lock means to allow the coarse adjustment position of the azimuth to be locked and retained prior to fine adjustment of the elevation and azimuth positions respectively.

13. The antenna assembly according to claim 1, wherein the powered drive means are servo motors.

14. The antenna assembly according to claim 1, wherein the control means include a modem which detects a strength of received data signals as adjustment of a position of the antenna is performed and, when the received data signals are detected as being of a predetermined condition, adjustment is stopped and an antenna position is set with respect to elevation and/or azimuth.

15. The antenna assembly according to claim 14, wherein the predetermined condition is a detection of a data signal with a bit error rate which is deemed to be at, or better than, a predetermined value deemed to allow acceptable further processing of the data to allow the required service to be generated from the received data signals.

16. A method for moving an antenna to an in-use position from a storage position, said method comprising the steps of:

moving support legs pivotally with respect to respective pivot connections on a second side or edge of a support hub to a spaced, in-use, position;

moving a bracket pivotally with respect to a pivot connection on a first side of the hub to an in-use position;

locating first and second parts of an antenna joined along an interface to the mounting bracket;

mounting a boom arm in position on the hub with a free end with data processing means positioned in front of the reflecting surface of the antenna; and wherein first and second adjustment means to provide coarse and fine tuning respectively of azimuth and elevation positions of the antenna are selectively operated to allow adjustment of a position of the antenna by selectively operating, for each of elevation and azimuth, the first adjustment means, locking the adjustment means and then selectively operating the second adjustment means which differ to the first adjustment means to provide the antenna at a desired position for receipt of data signals of a predetermined condition.

17. The method according to claim 16, wherein control means are provided which include a modem which detects the strength of the received data signal as adjustment of the position of the antenna is performed and, when the received data signals are detected as being in the predetermined condition, adjustment is stopped and the antenna position is locked with respect to the support hub and support legs.

18. The method according to claim 16, wherein the predetermined condition is met when the received data signal has a bit error rate which is at, or better than, a predetermined value.

* * * * *